US009567129B2

(12) United States Patent
Wong et al.

(10) Patent No.: US 9,567,129 B2
(45) Date of Patent: Feb. 14, 2017

(54) PACKAGE FOR STORING LIQUID FOOD, AND A BLANK FOR FORMING A PART OF SAID PACKAGE

(75) Inventors: Allen Wong, Lund (SE); Hanna Lejon, RÅÅ (SE); Pál Lövendahl, Lund (SE); Guido Wiener, Lund (SE); Per-Göran Heide, Furulund (SE); Anders Grim, Helsingborg (SE); Joachim Bjurenheim, San Martino in Rio (IT)

(73) Assignee: TETRA LAVAL HOLDINGS & FINANCE S.A., Pully (CH)

( * ) Notice: Subject to any disclaimer, the term of this patent is extended or adjusted under 35 U.S.C. 154(b) by 308 days.

(21) Appl. No.: 13/979,246

(22) PCT Filed: Jan. 25, 2012

(86) PCT No.: PCT/SE2012/050069
§ 371 (c)(1),
(2), (4) Date: Sep. 17, 2013

(87) PCT Pub. No.: WO2012/105891
PCT Pub. Date: Aug. 9, 2012

(65) Prior Publication Data

US 2014/0001248 A1 Jan. 2, 2014

(30) Foreign Application Priority Data

Jan. 25, 2011 (SE) ..... 1150043

(51) Int. Cl.

| | |
|---|---|
| ***B65D 5/42*** | (2006.01) |
| ***B31B 1/88*** | (2006.01) |
| ***B65D 5/46*** | (2006.01) |

(52) U.S. Cl.
CPC ..... *B65D 5/4208* (2013.01); *B31B 1/88* (2013.01); *B65D 5/46072* (2013.01); *B31B 2201/88* (2013.01)

(58) Field of Classification Search
USPC ..... 229/125.14, 125.15
See application file for complete search history.

(56) References Cited

U.S. PATENT DOCUMENTS

| | | | | |
|---|---|---|---|---|
| 2,751,072 | A * | 6/1956 | Ditmar | 206/457 |
| 3,268,146 | A | 8/1966 | Caseman | |
| 3,390,828 | A * | 7/1968 | Malby et al. | 229/117.12 |

(Continued)

FOREIGN PATENT DOCUMENTS

| | | |
|---|---|---|
| EP | 1 208 965 A2 | 5/2002 |
| JP | S55-61515 U | 4/1980 |

(Continued)

OTHER PUBLICATIONS

EPO machine translation of JP 2009/149,338 dated Jan. 28, 2016.*

(Continued)

*Primary Examiner* — Gary Elkins
(74) *Attorney, Agent, or Firm* — Buchanan Ingersoll & Rooney PC

(57) ABSTRACT

The invention relates to a package for enclosing a liquid food product. The package comprises an area having a tactile pattern for at least for indicating intended user grip and/or enhancing décor graphics. The invention also relates to a blank, a reel of blanks and a method of generating the tactile pattern.

26 Claims, 5 Drawing Sheets

(56) References Cited

U.S. PATENT DOCUMENTS

| | | | | | |
|---|---|---|---|---|---|
| 3,498,815 | A * | 3/1970 | Moors et al. | 427/145 |
| 3,628,719 | A * | 12/1971 | Ford, Sr. | 229/117.12 |
| 4,744,467 | A | 5/1988 | Jonsson et al. | |
| 4,804,134 | A * | 2/1989 | Reil | 229/117.23 |
| 4,828,539 | A | 5/1989 | Jönsson et al. | |
| 4,846,396 | A | 7/1989 | Palazzolo | |
| 5,857,615 | A * | 1/1999 | Rose | 229/403 |
| D448,285 | S | 9/2001 | Palm et al. | |
| 7,036,717 | B2 * | 5/2006 | Furini et al. | 229/125.15 |
| D581,796 | S | 12/2008 | Padain et al. | |
| 7,703,664 | B2 * | 4/2010 | Westphal et al. | 229/4.5 |
| 8,607,974 | B2 * | 12/2013 | de The et al. | 206/273 |
| 2005/0139645 | A1 * | 6/2005 | Shean et al. | 229/109 |
| 2006/0027640 | A1 * | 2/2006 | Smith et al. | 229/400 |
| 2011/0000802 | A1 | 1/2011 | Weiss et al. | |

FOREIGN PATENT DOCUMENTS

| | | | | |
|---|---|---|---|---|
| JP | S61-152545 | A | 7/1986 | |
| JP | H04-003918 | U | 1/1992 | |
| JP | 4-292935 | A | 10/1992 | |
| JP | 2000296569 | A | 10/2000 | |
| JP | 2003276725 | A | 10/2003 | |
| JP | 2008056254 | A | 3/2008 | |
| JP | 2008155966 | A | 7/2008 | |
| JP | 2009149338 | A | 7/2009 | |
| JP | 2009166867 | A | 7/2009 | |
| WO | WO 2005/097606 | A2 | 10/2005 | |
| WO | WO 2006/000820 | A2 | 1/2006 | |
| WO | WO 2009/101029 | A1 | 8/2009 | |
| WO | WO-2011/120857 | A1 * | 10/2011 | B65D 5/74 |

OTHER PUBLICATIONS

International Search Report (PCT/ISA/210) issued on May 24, 2012, by the Sweden Patent Office as the International Searching Authority for International Application No. PCT/SE2012/050069.

Japanese Office Action with English translation, corresponding to Japanese Patent Application No. 2013-550448, dated Nov. 30, 2015; 16 pages.

* cited by examiner

PACKAGE FOR STORING LIQUID FOOD, AND A BLANK FOR FORMING A PART OF SAID PACKAGE

TECHNICAL FIELD

The present invention relates to a package for liquid foods. More particularly the invention relates to a package provided with specific gripping properties.

BACKGROUND

Some existing carton-based packages for liquid foods comprise a tubular body extending between a closed bottom and a top. The bottom is typically planar such that the package can rest on a table, and the top typically comprises an opening arrangement.

Such disposable packages, particularly those for storing liquid foods, are frequently produced from a packaging laminate which consists of a core layer of paper, which layer is covered with a polymeric decor layer on a first, or outer, side. On the other side (i.e. the inner side facing the product to be enclosed) a multi-layer sheet is provided. The inner multi-layer typically comprises a first layer of polymeric material, a barrier film, and a second additional layer of polymeric material. The laminated packaging material is frequently supplied in the form of a continuous web being reeled on a storage reel and which, after having been unrolled from its storage reel converted, by means of folding, sealing, filling and folding into filled packaging containers in automatic filling machines.

Liquid food packages are provided in a number of different dimensions for enclosing liquid food, such as milk, juice, etc, of different volumes. For example, a juice package of the described disposable carton-based type may enclose a volume between 0.25 and 2 liters. Since the size of the package may vary widely, it may not be immediately clear for a user of the package how to grip the package in an optimum way for facilitating handling and pouring.

During the recent years there has been a technology development on how to design and position the opening arrangement in such a way the user is taught how to handle the package correctly. However, since different package providers, such as dairies etc, request specific designs of their packages such a solution may only be suitable in specific applications.

There is thus a need for a package which has improved handling and gripping capabilities.

SUMMARY

Accordingly, the present invention preferably seeks to mitigate, alleviate or eliminate one or more of the above-identified deficiencies in the art and disadvantages singly or in any combination and solves at least the above mentioned problems.

An object of the present invention is to provide a package that clearly indicates how the package should be handled or gripped in an optimum way.

A further object of the present invention is to provide a package that facilitates handling or gripping for users having a visual defect.

A yet further object of the present invention is to provide a package that reduces the risk of spill during pouring.

An idea of the present invention is thus to provide a package having a significant area, which significant area should preferably engage with a users hand during handling.

A yet further object of the present invention is to provide a package having a significant area which could also be used for enhancing or highlighting parts of the decor graphics of the package.

A yet further object of the present invention is to provide a package that may be sterilized in a secure way.

According to a first aspect of the invention a package for enclosing a liquid food product is provided. Said package is made of a fibre-based packaging material comprising a layer of carton. Said package having an outside surface and an inside surface, said outside surface comprising an area having a tactile pattern for at least indicating intended user grip and/or enhancing decor graphics. Said tactile pattern is manufactured in the packaging material through compression of at least the layer of carton. Said inside surface is having an even area being positioned in correspondence to at least the area having the tactile pattern on the outside surface. The area having a tactile pattern covers a limited portion of the outer surface of the package and is preferably designed in size and shape to match the extent of at least a part of an inner side of a hand, i.e palm and/or fingers. Preferably, said area having a tactile pattern is arranged on two opposite sides of the package in such a way that gripping of the package is allowed by placing the thumb on the tactile pattern on a first side of the package and one or several of the other fingers on the tactile pattern on the second, opposite side of the package. Having an even interior surface unaffected by the tactile pattern is important when it comes to sterilization of the packages. A patterned surface may more easily hold dirt, bacteria and other microbiological material, and it may be more difficult to sterilize such a surface.

The tactile pattern comprises recessed portions having a depth of at least 30 μm, preferably at least 50 μm. This is considered to be the minimum depth that is sensible for a consumer.

The tactile pattern comprises a compression pattern comprising recessed portions. This is advantageous in that the tactile pattern may be provided only to the outside of the package leaving the interior surface even or flat at least in the area opposed to the area of the tactile pattern.

The package comprises a hollow body of a carton-based packaging material extending from a closed bottom end towards a closed top portion. Said area is having a tactile pattern provided on said hollow body or on said top portion, or on both. Hence, the tactile pattern may be used for clearly indicating the boundaries within which the package should be gripped for optimum handling. For example, a relatively small package like a 0.25 liters juice package may require that the thumb of a user extends over the top, while a relatively big package like a 2 liters juice package may require a grip well below the closed top portion.

The area having a tactile pattern continuously extends from the hollow body to the top portion visually linking the hollow body and the top portion together.

The package comprises an opening arrangement. Said opening arrangement may further be re-closeable and it may be a screw cap. This is advantageous in that the risk of spill during pouring is further reduced, as the area having a tactile pattern may be positioned correctly relative the opening arrangement.

Said opening arrangement is positioned at an off-center position relative the package.

The area having a tactile pattern is provided on a portion of the package being substantially opposite the portion provided with the opening arrangement. This is advantageous in that an efficient and spill-safe position of the opening arrangement can be used as the tactile pattern prevents the user from gripping the package in a wrong way. Preferably said area having a tactile pattern is only provided on the opposite side of the package in relation to the position of the opening.

The opening arrangement and the tactile area are arranged offset in relation to each other in a direction substantially perpendicular to a longitudinal centre axis of the package.

The area having a tactile pattern is provided on said hollow body and on said top portion continuously distributed at the interface between the hollow body and the top portion. Hence, if there is a disruptive interface between the hollow body and the top portion this interface will exhibit a more smooth transition as the tactile pattern extends over said interface. Consequently, the risk of sharp edges at the interface is reduced.

The top portion is made of a polymeric material and being rigidly connected along its periphery to an upper end of said hollow body for closing said package. This is advantageous in that the top portion may be molded in many different shapes, while the hollow body being identical independent of the shape of the top portion is conforming to the shape of the top portion. Hence, different shapes of the package may be provided in a simple and cost effective way.

The periphery of said top portion is defining a shape having a waist, and wherein at least one of the lateral sides of the hollow body, extending between the bottom end and the top portion, comprises a crease line arrangement for assisting the at least one lateral side to conform to the waist shape.

The top portion has a front portion and a back portion being separated by means of said waist, said opening arrangement being arranged at the front portion. The back portion and the crease line arrangement are adapted to shape a portion of the hollow body into a user grip, said user grip being provided with said area having a tactile pattern.

The package comprises an area of non-tactile type adjacent said area having a tactile pattern. The area of non-tactile type is arranged adjacent the area having a tactile pattern in a direction in parallel with a plane defined by the closed bottom end. Said area of non-tactile type may be defined by a less coefficient of friction than the area of the tactile pattern. Said area of non-tactile type is preferably relatively smooth. Preferably, said area of non-tactile type is arranged adjacent the area having a tactile pattern in a direction in parallel with a plane defined by the closed bottom end. Preferably, said area of non-tactile type extends over at least 180° of the package. Said area of non-tactile type is formed by an outer surface of the package and extends over a substantial part of the outer surface of the package. Said area of non-tactile type preferably surrounds said area of tactile type.

According to a second aspect of the invention a blank for forming said package is provided. Said blank is made of a fibre-based packaging material comprising a layer of carton and is provided with crease lines. The blank comprises an area having a tactile pattern at least for indicating intended user grip and/or enhancing decor graphics. Said tactile pattern is being manufactured through compression of at least the layer of carton. The area of tactile pattern is provided to a first side of the blank which first side will form the outside of the package. A second side of the blank will form the inside of the package and is even in an area being positioned in correspondence to at least the area having the tactile pattern.

The tactile pattern comprises recessed portions having a depth of at least 30 μm, preferably at least 50 μm.

The tactile pattern comprises a compression pattern comprising recessed portions.

The blank forms a part of a package for enclosing a liquid food product when its lateral ends are sealed together to form a hollow body, and a bottom section of said hollow body is sealed to form a closed bottom end when it is folded along the crease-lines.

The blank is having a first end, a second end and two lateral ends extending between the first end and the second end. Said crease lines comprise a first set of crease lines arranged at said first end. Said blank is sealable along the two lateral ends for forming a hollow body. Said first set of crease lines is disposed such that said first end is forming a closed bottom end when said blank is folded along said first set of crease lines. The crease lines comprise a second set of crease lines arranged at said second end, wherein said second set of crease lines is disposed such that said second end is assisted in conforming to a lower part of the top portion, said lower part having a periphery defining a shape having a waist. Said second set of crease lines is adapted to help shaping a portion of the hollow body into a user grip, said user grip being provided with said area having a tactile pattern.

The second set of crease lines is arranged in the same end of the blank as the second configuration of the first crease lines.

According to a third aspect of the invention a reel of packaging material is provided. The reel comprised a continuous web of a plurality of subsequently arranged portions, wherein each portion defines a blank as described above.

According to a fourth aspect of the invention a method for generating a tactile pattern is provided. The tactile pattern is generated, using compression technique, on a fibre-based packaging material comprising a layer of carton. The method comprises the steps of providing a roller which is able to exert a pressure on a first side of the packaging material, said roller having a patterned surface, and providing a counter element on the second side of the packaging material, said counter element having an un-patterned surface.

BRIEF DESCRIPTION OF THE DRAWINGS

These and other aspects, features and advantages of which the invention is capable of will be apparent and elucidated from the following description of embodiments of the present invention, reference being made to the accompanying drawings, in which.

DESCRIPTION OF EMBODIMENTS

Embodiments of the present invention will be described in more detail below with reference to the accompanying drawings in order for those skilled in the art to be able to carry out the invention. The invention may, however, be embodied in many different forms and should not be construed as limited to the embodiments set forth herein. The embodiments do not limit the invention, but the invention is only limited by the appended patent claims. Furthermore, the terminology used in the detailed description of the particular embodiments illustrated in the accompanying drawings is not intended to be limiting of the invention.

Figure 1:
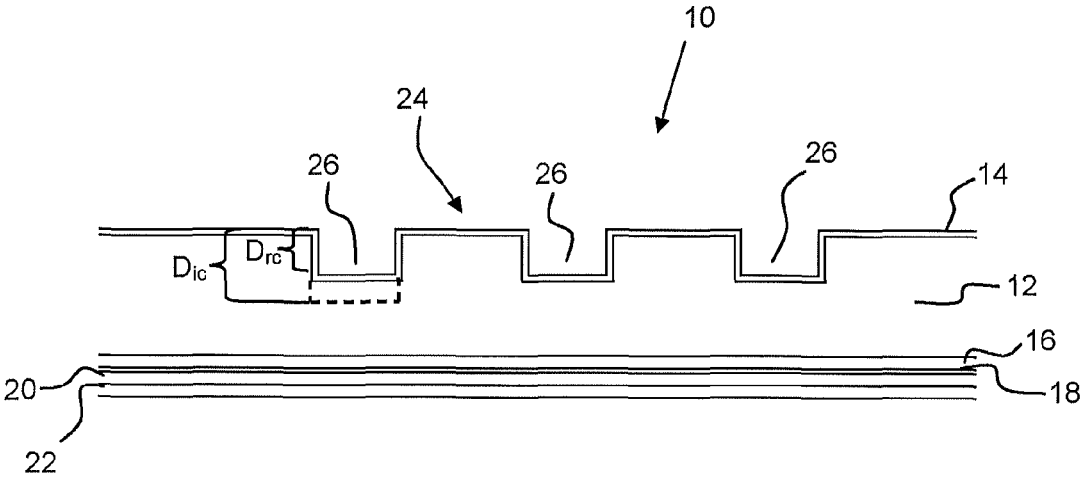
FIG. 1 is a cross sectional view of a packaging laminate.

With reference to FIG. 1, a packaging material 10 is shown. The packaging material is used for forming a package suitable for enclosing liquid food, and comprises a laminate structure. A layer 12 of carton is on one side covered by an outer, transparent layer 14 of polymeric material, such as for example PE. Before coating, the layer 12 may be provided with a decor showing details of the product to be enclosed by the package, brand names and/or other visual details being of interest to the user. The outer layer 14 will protect the carton layer 12 from the outer environment, such as humidity, dirt, pollutions, etc. On the other side of the carton layer 12, i.e. the side facing the product to be enclosed, a multi-layer structure is provided. A first layer 16 of polymeric material, such as for example PE, is provided adjacent to the carton layer 12. A barrier film 18 of e.g. aluminum is bonded to the layer 16, and an adhesive layer 20 is provided on the barrier film 18 before a final layer 22 of polymeric material is arranged to be in contact with the food enclosed by the future package. The term carton is to be defined as being a fibre-based material, such as for example board or paperboard.

The packaging material 10 is further provided with an area 24 having a tactile pattern. The tactile pattern is provided as recessed regions 26 in the carton layer 12 and the outer layer 14 of PE in such a way that the user will feel the tactile pattern of the packaging material 10. In other embodiments the tactile pattern may also be provided as protrusions on the carton layer 12, or as recesses or protrusions within the outer polymer layer 14.

The recessed regions 26 of the carton layer 12 are preferably provided as compression regions by having a roller compressing the patterns while a continuous web of packaging material is fed through a roller system. More specifically this may be accomplished by providing a roller which is able to exert a pressure on an outer first side of the packaging material, said roller having a patterned surface, and by providing a counter element on the inner, second side of the packaging material, said counter element having an un-patterned surface. The roller with the patterned surface will act on the side of the packaging material which is supposed to be the outside when forming a package, and the patterned surface is a negative pattern of the tactile pattern. Hence, the un-patterned surface of the counter element will act on the side of the packaging material which is supposed to form the inside of the package. The compression technique provides the possibility of leaving the inside surface of the packaging material unaffected by the tactile pattern, i.e. an area of the package interior surface being positioned in correspondence to at least the area having the tactile pattern on the outside surface, is even. Being positioned in correspondence to means here that the area of the tactile pattern is opposing the inside surface area being even. The compression force used to form recessed portions 26 on the outside surface will not create any protrusions on the inside surface. Having an even interior surface unaffected by the tactile pattern is important when it comes to sterilization of the packages.

The counter element may be a roller, a conveyor or any other surface that is suitable for acting as a counter element to a roller. The packaging material is fed between the patterned roller and the counter element.

The recessed regions 26 may preferably be made on a finished packaging material, i.e. after lamination and after making crease lines (which two steps may be made in any order depending on material choice and choice of converting process). However, the recessed regions may be made before lamination. Hence, the term packaging material should in this specific case refer to the carton layer 12 only, said carton layer being in the form of a continuous web that is being fed through a roller system of the type described above.

Further, the recessed regions 26 may be made together with the crease lines in one single step.

The carton material being used in packaging material for liquid food packages can be considered elastic in that they, after being compressed, to at least some degree will strive towards their original shape, i.e. to the un-compressed state. When creating a recessed area with tactile pattern this may be necessary to compensate for by initially make a compression to a larger depth than the depth sufficient for the tactile pattern. In this regard two terms may be used: Initial compression depth $D_{ic}$ and retained compression depth $D_{rc}$. The two of them are shown in FIG. 1. The initial compression depth $D_{ic}$ is the depth reached by the compression roller and the retained compression depth $D_{rc}$ is the depth to which plastic deformation is accomplished, i.e. the depth at which the packaging material will remain as a result of the compression. Depending on the characteristics of the packaging material, i.e. to what extent it will strive back to its un-compressed state, a suitable initial compression depth may be chosen so that in the end a desired retained compression depth $D_{rc}$ will be accomplished.

Some initial tests have shown that, in order for a consumer to be able to sense and visually percept the tactile pattern, the depth ($D_{rc}$) of the recessed portions 26 should be at least 30 μm, preferably at least 50 μm.

The area of the tactile pattern may have any shape suitable for indicating intended user grip and/or enhancing decor graphics, and the recessed portions 26 of the area of the tactile pattern may also have any shape, for example any of dots, lines, rectangles, triangles, honeycomb shapes, wave-formed shapes, ellipses etc.

The present invention can naturally be employed to a wide range of package types, for example parallelepipedic packages, wedge-shaped packages, cushion-shaped packages, carton bottles and gable-top packages etc.

Figure 2:
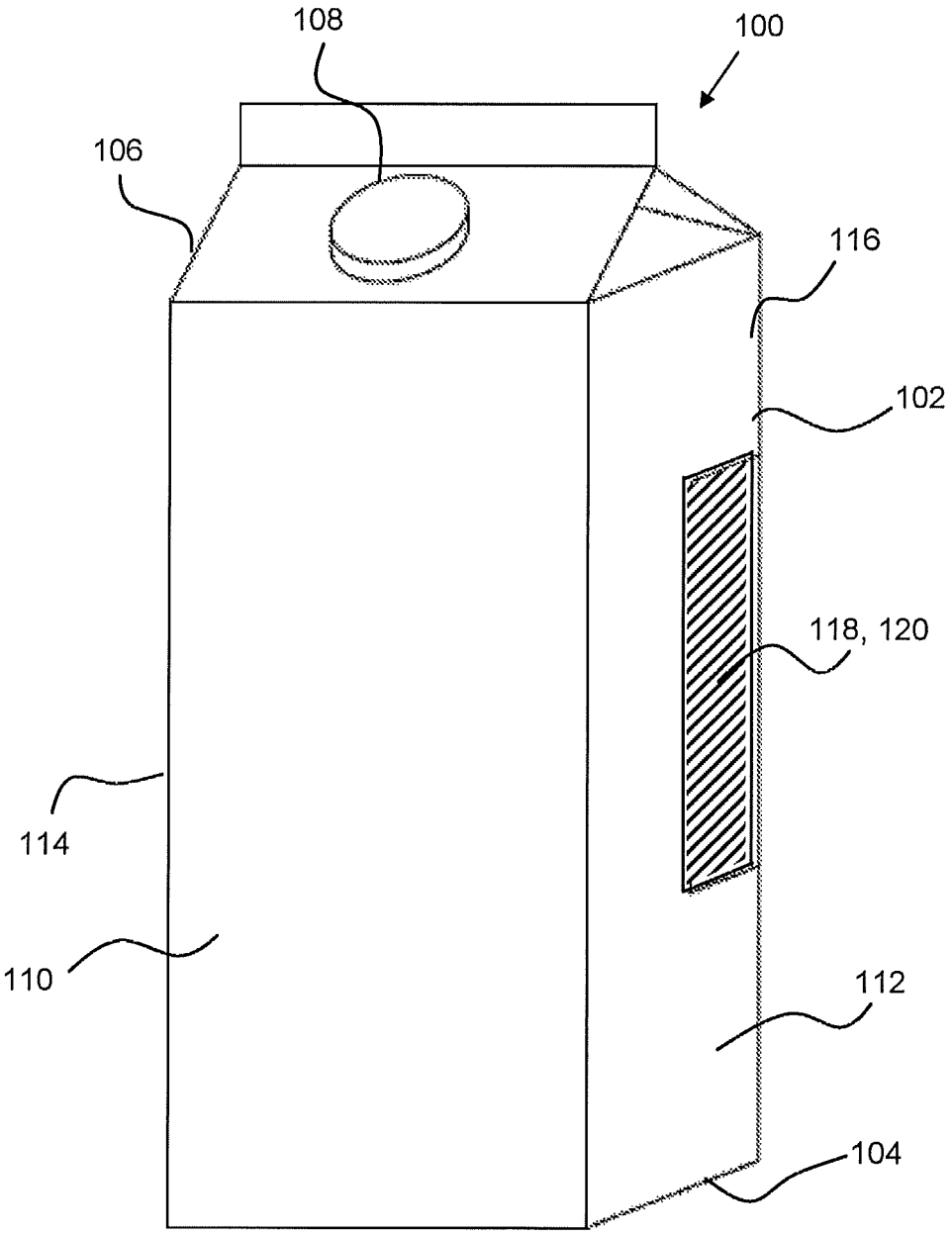
FIG. 2 is a perspective view of a package according to a first embodiment.

With reference to FIG. 2, a package 100 according to a first embodiment is shown. The package 100 comprises a hollow body 102 of a packaging material extending between a closed bottom 104 towards a closed top portion 106. The packaging material may be of the kind previously described, but other carton based structures may also be used for this kind of package.

In this embodiment, the top portion 106 is integrally formed with the hollow body 102. An opening arrangement 108 is provided at an off-center position on the top portion 106. The opening arrangement 108 is a re-closeable screw cap.

The hollow body 102 of the package 100 has five sides, including the bottom 104, a front side 110, two lateral sides 112, 114, and a back side 116. The front side 110 is defined as the side facing the same direction as the opening arrangement 108.

A main part of the package comprises an area of a non-tactile type. This area of non-tactile type covers the complete front side 110, a main part of the back side 116 and the main part of each of the lateral sides 112,114.

An area 118 is provided on the package 100, which area 118 is provided with a tactile pattern 120 of the kind described in relation to FIG. 1. The area 118 is arranged on the back side 116 of the hollow body 102, and extends to cover a part of the lateral sides 112, 114 as well. Hence, the areas are provided on a portion of the package 100 being substantially opposite the portion provided with the opening arrangement 108.

When a user is about to grab the package 100, he may sweep his fingers over the package and identify the tactile patterned area 118. As the position of the area 118 is determined in view of the position of the opening arrangement 108, the user is immediately aware of how to hold the package 100 to be able to pour the enclosed content without spill.

In a further embodiment, the area 118 may instead be two isolated areas located on the two lateral sides 112, 114. That is, the back side 116 is left unpatterned.

Figure 3:
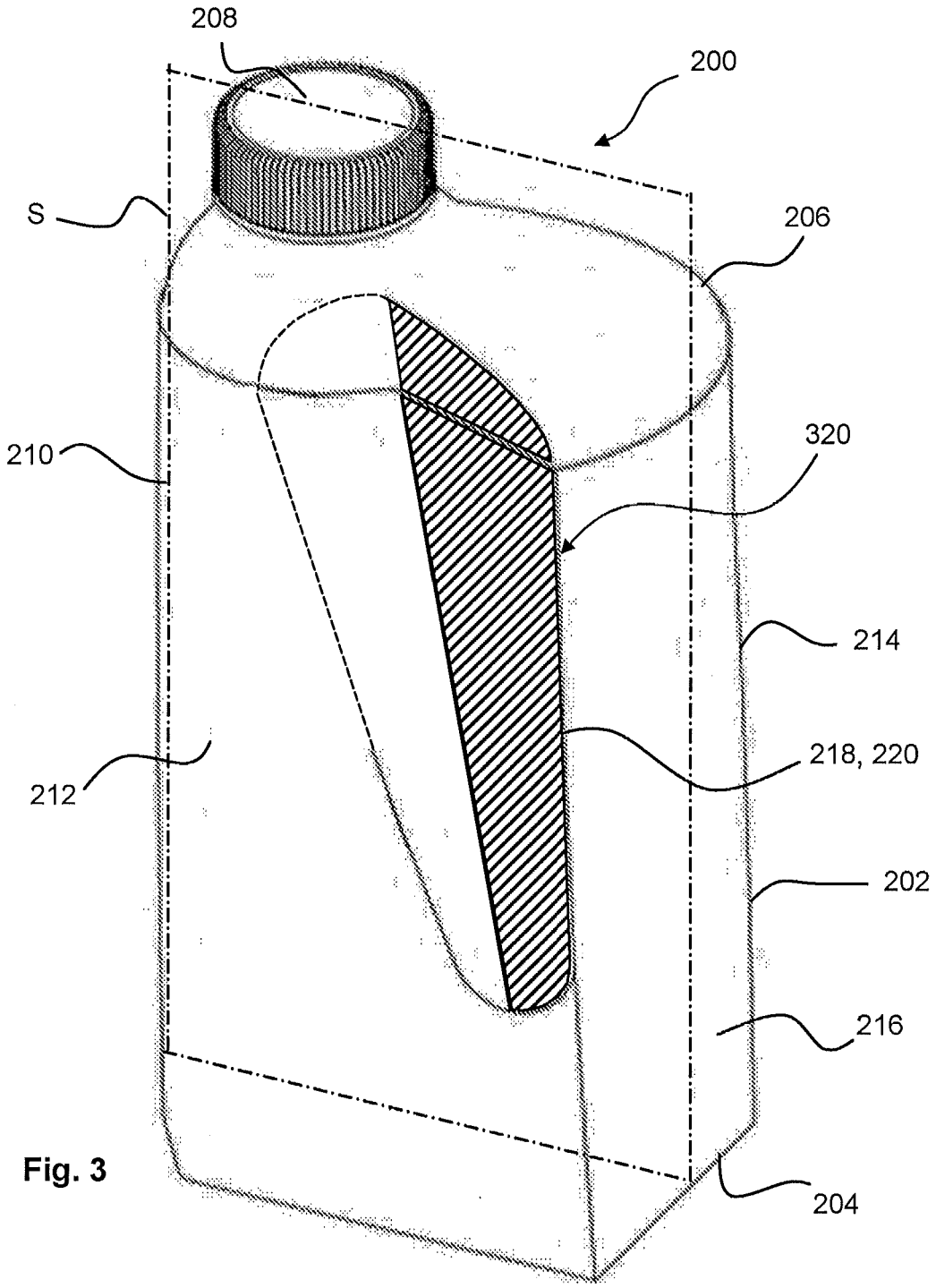
FIG. 3 is a perspective view of a package according to a second embodiment.

In FIG. 3, a package 200 according to a second embodiment is shown. The package 200 is generally denoted a carton bottle and comprises a hollow body 202 of a packaging material extending between a closed bottom 204 towards a closed top portion 206. The packaging material may be of the kind described in relation to FIG. 1, but other carton-based structures may also be used for this kind of package.

In this embodiment, the top portion 206 is formed as a separate plastic top being injection molded onto the hollow body 202. The plastic top is preferably opaque. The lower part of the top portion 206 has a periphery defining a shape having a waist. An opening arrangement 208 is provided at an off-center position on the top portion 206. The opening arrangement 208 is a re-closeable screw cap.

In an embodiment, the periphery of the lower part of the top portion 206 of a package has a front portion and a back portion being separated by means of said waist, and wherein said opening arrangement 208 is arranged at the front portion.

The hollow body 202 of the package 200 has five sides, including the bottom 204, a front side 210, two lateral sides 212, 214, and a back side 216. The front side 210 is defined as the side at which the opening arrangement 208 is arranged. A symmetry plane S is shown, which symmetry plane is substantially perpendicular to a plane constituting the bottom 204. The symmetry plane S naturally extends through the center of the package 200 and is aligned with a longitudinal centre axis of the package.

Two areas 218 are provided on the package 200, of which only one area 218 is shown. The areas 218 are provided with a tactile pattern 220. The two areas 218 are arranged on the lateral sides 212, 214 of the hollow body 202 and extend continuously to the top portion 206 visually linking the hollow body and the top portion together.

Further, as can be seen in FIG. 3, the areas are provided on a portion of the package 200 being substantially opposite the portion provided with the opening arrangement 208.

Since the top portion 206 is made of an injection molded polymeric material, the tactile pattern is preferably provided as a recessed pattern being defined by the wall of the cavity of the injection mold. In an embodiment, the dimensions of the recesses of the polymeric top portion 206 are identical with the dimensions of the recesses in the packaging material. In another embodiment, the dimensions of the recesses of the polymeric top portion 206 are adjusted relative the dimensions of the recesses of the packaging material such that the experienced feeling from a user is identical over the complete area 218.

Due to the shape of the top portion 206, the hollow body 202 is forming a so called recessed handle when the hollow body 202 is conforming to the shape of the top portion 206. The recessed handle is enabled due to the provision of the waist shaped top portion 206. Further, a crease line arrangement 320 is provided for allowing the hollow body 202 to form the recessed handle, as well as to increase the stability of the package 200. The crease line arrangement 320 will be described in detail further down in relation to the blank.

When a user is about to grab the package 200, he may sweep his fingers over the package and identify the tactile patterned areas 218. As the position of the areas 218 are determined in view of the position of the opening arrangement 208, the user is immediately aware of how to hold the package 200 to be able to pour the enclosed content without spill.

Figure 4:
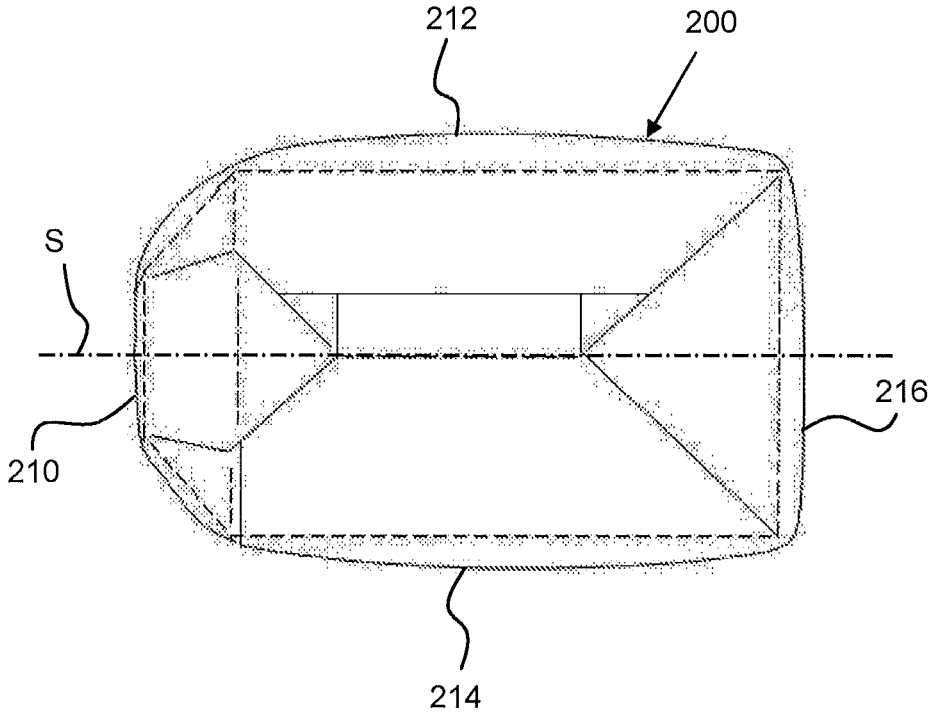
FIG. 4 is a view of the bottom configuration of the package according to the second embodiment.

FIG. 4 shows the bottom 204 of the package. The bottom is defining a planar surface having a D-shape. The D-shape is achieved by the provision of two different crease line configurations, one at a front portion and one at a back portion of the package. These crease line configurations will be described in detail further down in relation to the blank.

Figure 6:
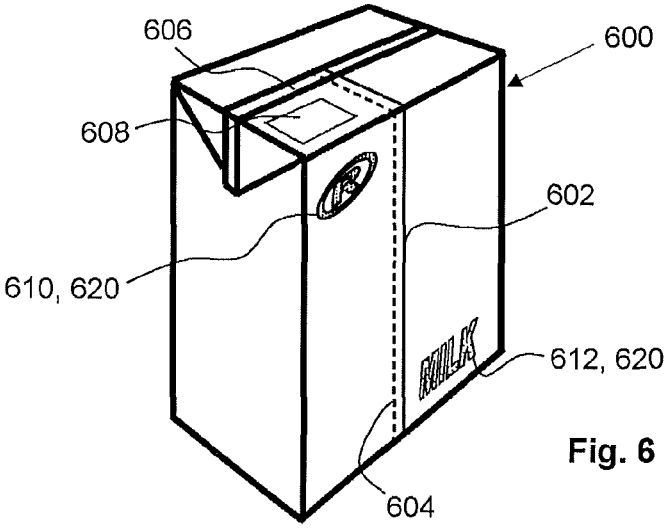
FIG. 6 is a perspective view of a package according to a third embodiment.

FIG. 6 shows a parallelepipedic packaging container 600 which is manufactured from a tube-shaped packaging material. Such packaging containers are often produced in that a web of packaging material is reformed into a tube so that the one longitudinal edge of the material web 602 joiningly overlaps the other longitudinal edge 604 (shown as a hidden line), whereafter the tube is filled with the intended contents and sealed along narrow transverse mutually spaced apart sealing zones 606. The sealed-off portions of the tube thus containing contents are thereafter separated from the tube by means of incisions in these sealing zones and, thereafter folded such that corner flaps are formed, which are sealed towards the package sides and bottom.

The packaging material may be of the kind described in connection with FIG. 1. The one longitudinal edge 602 of the material overlaps the second longitudinal edge 604 in a permanent seal and the two seals 606 disposed transversely of the longitudinal direction of the tube are disposed substantially at right angles to the longitudinal direction of the tube. On the forming operation, the longitudinal overlap joint is positioned substantially in the centre of the one longitudinal side of the packaging container.

The package 600 has an opening arrangement 608 on its top surface. The opening arrangement may be of any conventional type; pull-tab, screw cap, hinged opening device etc.

The package 600 is provided with two areas 610, 612 of tactile pattern 620 manufactured as discussed above. The placement of the areas is dependent on the purpose of the tactile pattern. An area of tactile pattern could be used to create a visual effect which may enhance the decor graphics of the package, i.e. which can give a "further dimension" to the two dimensional graphics printed on the packaging laminate. For example, certain parts of the graphics may be highlighted by adding a tactile pattern. In the shown embodiment the areas of the tactile pattern is positioned over parts of the decor graphics in order to enhance a fictive brand name "®", denoted 610, and a descriptive text such as for example "milk", denoted 612, representing the content of the package. Further, the tactile pattern may as well be used to generate braille to inform blind people about for example the content of a package. This is advantageous since blind people are forced to rely on for example the sense to obtain information. However, the drawing is not presenting braille.

The invention also relates to a blank, for forming a package, having crease lines and an area with tactile pattern.

The blank is for example made of a packaging material as described in relation to FIG. 1.

Generally, said blank is made of a carton-based packaging material comprising crease lines and an area having a tactile pattern. Said tactile pattern is provided by compression of at least a layer of carton in the carton-based packaging material. Further, said tactile pattern is provided to a first side of the blank which first side will form the outside of the package. A second side of the blank, which will form the inside of the package, is substantially even at least in an area corresponding to that of the tactile pattern, to facilitate sterilization.

During some initial tests it has been found that it is preferred to have a distance between a boundary of the tactile pattern area and any crease lines or sealing zones not to have any potentially negative impact when folding the package. Presently it has been found that a distance between a boundary of the area of the tactile pattern and any crease line or sealing zone should preferably be at least 0.5, preferably at least 1 mm or more. The wording "any crease line" is referring to all crease lines, but the distance is obviously especially applicable to crease lines in the vicinity of the areas of tactile pattern. This distance may well be used also between the tactile pattern and any sealing zones, i.e. zones where sealing of the packaging material is made to form a package. In the FIG. 3 embodiment there is two kinds of sealing zones. The top portion 206 is injection molded onto the hollow body 202, and because the polymeric layers of the packaging material is melting together with the top portion, the hollow body can be said to be sealed to the top portion, the material overlap constituting the sealing zone. The longitudinal sealing formed when the two lateral ends 306 of the blank forms a second kind of sealing zone. In the FIG. 6 embodiment the joining overlap between the edges 602 and 604 is another sealing zone, as well as seal 606.

Figure 5:
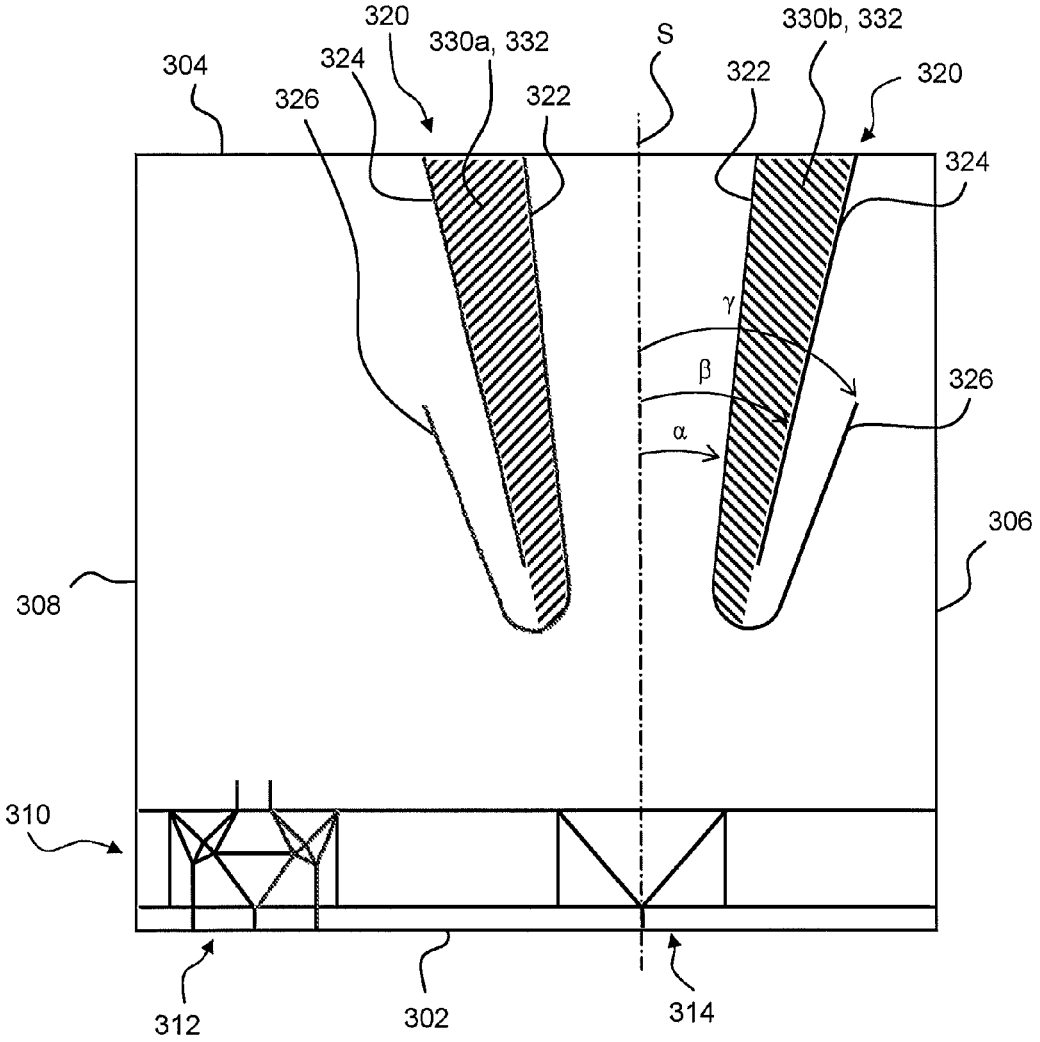
FIG. 5 is a blank for forming a part of the package shown in FIG. 3.

In FIG. 5 a first embodiment of a blank 300 is shown. The blank 300 is provided in order to allow for a hollow body of the package shown in FIG. 3 to be formed when folded and sealed according to the following description. In this embodiment the blank 300 is a rectangular area and has a first, bottom end 302, a second, top end 304, and two lateral ends 306, 308 between which ends the blank extends.

The blank comprises a first set of crease lines 310 arranged at said bottom end 302, and a second set of crease lines 320 arranged at said top end 304, wherein said blank is sealable along the two lateral ends 306, 308 for forming a hollow body. The first set of crease lines 310 is disposed such that said bottom end 302 is forming a closed bottom end when said blank is sealed and folded along said first set of crease lines 310.

The second set of crease lines 320 may be disposed such that said top end 304 is assisted in conforming to a shape of a top portion, said shape having a waist.

Further, the first set of crease lines 310 may comprise a first configuration of crease lines 312 disposed such that a front side of the bottom end having four corners is formed when the blank is folded along the first disposition of crease lines 312.

The first set of crease lines 310 may further comprise a second configuration of crease lines 314 disposed such that a back side of the bottom end having two corners is formed when the blank is folded along the second disposition of crease lines 314. FIG. 4 shows the final bottom end as a result of the first and second crease configurations 312, 314.

The first set of crease lines 310 and the second set of crease lines 320 may be arranged such that a longitudinal sealing formed when the two lateral ends 306, 308 are sealed to each other does not pass through the first or second set of crease lines 310, 320.

When the blank 300 is folded along the crease lines 310, 320, and sealed at the bottom end 302 as well as at the lateral sides 306, 308, it will form a hollow body in accordance with what is shown as a hollow body 202 in FIG. 3.

The second set of crease lines 320 extends from the upper end 304 towards a lower region, said lower region being arranged between the closed bottom end 302 and said upper end 304. Further, the second set of crease lines 320 comprises a first pair of mutual reversed crease lines 322. One crease line 322 is positioned on each side of the plane of symmetry S of the package to be formed. The plane S is shown as a symmetry line in FIG. 5. Said mutual reversed crease lines 322 are being positioned at a distance from the symmetry plane S and are angled in respect of said plane. Further, the second set of crease lines 320 comprises a second pair of mutual reversed crease lines 324, wherein one crease line is positioned on each side of the symmetry plane S. As with the first mutual reversed crease lines 322, the second crease lines 324 are being positioned at a distance from the plane and are angled in respect of said plane. Furthermore, the second set of crease lines 320 comprises a third pair of mutual reversed crease lines 326, wherein one crease line is positioned on each side of the symmetry plane and, like the other crease lines, they are positioned at a distance from said plane and angled in respect of said plane.

The first pair of crease lines 322 is arranged closest to the plane S and is having a first angle $\alpha$ to the plane S. The second pair crease lines 324 is having a second angle $\beta$ to the plane S, said second angle $\beta$ being larger than the first angle $\alpha$. The third pair of crease lines 326 is having a third angle $\gamma$ to the plane, said third angle $\gamma$ being larger than the second angle $\beta$. The crease lines of the first and third pairs 322, 326, on each respective side of the plane, are connected by a curve 328. Hence, a first and a third crease line 322, 326 from each pair forms a single crease line.

The crease lines of the first, second and third pairs 322, 324, 326 are angled such in relation to the plane that the angles $\alpha$, $\beta$, $\gamma$ increase in a direction towards the upper end 304 of the blank.

As can be seen in FIG. 5, the second set of crease lines 320 is arranged in the same end of the blank as the second configuration of the first crease lines 310. Both the second set of crease lines 320 and the second configuration of the first crease lines 310 are centrally aligned to the symmetry plane S.

Two areas 330*a*, 330*b* are provided on the blank 300, each area 330*a*, 330*b* having a tactile pattern 332. Each respective area 330*a*, 330*b* is arranged between the crease lines 322, 324 of the first and second pairs. In the embodiment shown, the areas are bounded, on three sides, by the first and second crease lines and the upper end 304 respectively.

The areas having a tactile pattern, in this embodiment the areas 330*a*, 330*b*, are preferably made through the compression technique as already described in connection with the packaging material of FIG. 1.

The invention also relates to a reel of packaging material comprising a continuous web of a plurality of subsequently arranged portions, wherein each portion defines a blank. For example a blank 300 like the one previously described in relation to FIG. 5.

The invention has mainly been described above with reference to a few embodiments. However, as is readily appreciated by a person skilled in the art, other embodiments than the ones disclosed above are equally possible within the scope of the invention, as defined by the appended patent claims. It should further be noted that any reference to "front", "back", "upper", or "lower", etc., is only made for illustrative purpose and is by no means limiting the scope of the claims.

Two embodiments have been described in which the area having a tactile pattern is provided on a portion of the package being substantially opposite the portion provided with the opening arrangement, and that the opening arrangement is arranged offset the center of the package. In another embodiment, not shown, the opening arrangement and the area having a tactile pattern are arranged offset in relation to each other. The area having a tactile pattern is for example arranged centrally in relation the package whereas the opening arrangement is being arranged offset the center of the package. Hence, the offset direction may be defined as being a direction substantially perpendicular to a longitudinal centre axis of the package. The opening arrangement and the area having a tactile pattern may of course at the same time be offset in relation to each other in a direction substantially aligned with the longitudinal centre axis of the package.

The invention claimed is:

1. A multi-layer package laminate for enclosing a liquid food product, said package being made of a fibre-based packaging material comprising a layer of carton and an outer polymer layer, wherein said package having an outside surface and an inside surface, said outside surface comprising an area having a tactile pattern for at least indicating intended user grip and/or enhancing décor graphics, said tactile pattern being manufactured in the packaging material through compression of at least the layer of carton and/or the outer polymer layer leaving remaining layers in the package laminate uncompressed, and said inside surface having an even area being positioned in correspondence to at least the area having the tactile pattern on the outside surface.

2. The package according to claim 1, wherein said tactile pattern comprises recessed portions having a depth of at least 30 μm.

3. The package according to claim 1, wherein said tactile pattern comprises a compression pattern comprising recessed portions.

4. The package according to claim 1, wherein the package comprises a hollow body of a carton-based packaging material extending from a closed bottom towards a closed top portion, wherein said area having a tactile pattern is provided on said hollow body or on said top portion, or on both.

5. The package according to claim 4, wherein the area having a tactile pattern continuously extends from the hollow body to the top portion visually linking the hollow body and the top portion together.

6. The package according to claim 1, wherein the package comprises an opening arrangement.

7. The package according to claim 6, wherein said opening arrangement is positioned at an off-center position relative the package.

8. The package according to claim 6, wherein said area having a tactile pattern is provided on a portion of the package being substantially opposite the portion provided with the opening arrangement.

9. The package according to claim 6, wherein the opening arrangement and the tactile area are arranged offset in relation to each other in a direction substantially perpendicular to a longitudinal centre axis of the package.

10. The package according to claim 4, wherein said area having a tactile pattern is provided on said hollow body and on said top portion, and wherein the area having a tactile pattern is continuously distributed at an interface between the hollow body and the top portion.

11. The package according to claim 4, wherein the top portion, is made of a polymeric material, said top portion being rigidly connected along its periphery to an upper end of said hollow body for closing said package.

12. The package according to claim 11, wherein the periphery of said top portion is defining a shape having a waist, and wherein at least one of the lateral sides of the hollow body, extending between the bottom end and the top portion, comprises a crease line arrangement for assisting the at least one lateral side to conform to the waist shape.

13. The package according to claim 12, wherein the top portion has a front portion and a back portion being separated by means of said waist, said opening arrangement being arranged at the front portion and, wherein the back portion and the crease line arrangement are adapted to shape a portion of the hollow body into a user grip, said user grip being provided with said area having a tactile pattern.

14. The package according to claim 1, wherein said package comprises an area of non-tactile type adjacent said area having a tactile pattern.

15. The package according to claim 14, wherein said area of non-tactile type is arranged adjacent the area having a tactile pattern in a direction in parallel with a plane defined by the closed bottom end.

16. A blank for forming the package as claimed in claim 1, said blank is made of a fibre-based packaging material comprising a layer of carton and provided with crease lines, wherein the blank comprising an area having a tactile pattern at least for indicating intended user grip and/or enhancing decor graphics, said tactile pattern being manufactured through compression of at least the layer of carton, and wherein the area of tactile pattern is provided to a first side of the blank which first side will form the outside of the package, and wherein a second side of the blank, which will form the inside of the package, is even in an area being positioned in correspondence to at least the area having the tactile pattern.

17. The blank according to claim 16, wherein the tactile pattern comprises recessed portions having a depth of at least 30 μm.

18. The blank according to claim 16, wherein the tactile pattern comprises a compression pattern comprising recessed portions.

19. The blank according to claim 16, said blank being a blank that forms a part of a package for enclosing a liquid food product when its lateral ends are sealed together to form a hollow body, and a bottom section of said hollow body is sealed to form a closed bottom end when it is folded along the creaselines.

20. The blank according to claim 19, having a first end, a second end and two lateral ends extending between the first end and the second end, wherein said crease lines comprises:

a first set of crease lines arranged at said first end, wherein said blank is sealable along the two lateral ends for forming a hollow body, said first set of crease lines is disposed such that said first end is forming a closed bottom end when said blank is folded along said first set of crease lines, and wherein the crease lines comprises a second set of crease lines arranged at said second end, wherein said second set of crease lines is disposed such that said second end is assisted in conforming to a lower part of the top portion, said lower part having a periphery defining a shape having a waist and, wherein said second set of crease lines is adapted to help shaping a portion of the hollow body into a user grip, said user grip being provided with said area having a tactile pattern.

21. The blank according to claim 20, wherein the second set of crease lines is arranged in the same end of the blank as a second configuration of the first crease lines.

22. A reel of packaging material comprising a continuous web of a plurality of subsequently arranged portions, wherein each portion defines a blank according to claim 16.

23. The package according to claim 1, wherein said tactile pattern comprises recessed portions having a depth of at least 50 μm.

24. The blank according to claim 16, wherein the tactile pattern comprises recessed portions having a depth of at least 50 μm.

25. A multi-layer package laminate for enclosing a liquid food product, the package being made of a fibre-based packaging material comprising a layer of carton and an outer polymer layer, the package comprising:

a hollow body of a carton-based packaging material extending from a closed bottom towards a closed top portion;

an outside surface comprising an area having a tactile pattern for at least indicating intended user grip and/or enhancing decor graphics, the tactile pattern being manufactured in the packaging material through compression of at least the layer of carton and/or the outer polymer layer leaving remaining layers in the package laminate uncompressed;

an inside surface having an even area being positioned in correspondence to at least the area having the tactile pattern on the outside surface;

wherein the area having the tactile pattern is provided on the hollow body and the top portion; and wherein the area having the tactile pattern is continuously distributed at an interface between the hollow body and the top portion.

26. A multi-layer package laminate for enclosing a liquid food product, the package being made of a fibre-based packaging material comprising a layer of carton, an outer polymer layer and other layers, the package comprising:

a hollow body of a carton-based packaging material extending from a closed bottom towards a closed top portion, the top portion possessing a periphery rigidly connected to an upper end of the hollow body for closing the package, the top portion being made of a polymeric material;

an outside surface comprising an area having a tactile pattern for at least indicating intended user grip and/or enhancing decor graphics, the tactile pattern being manufactured in the packaging material through compression of at least the layer of carton leaving a plurality of the other layers uncompressed;

an inside surface having an even area being positioned in correspondence to at least the area having the tactile pattern on the outside surface; and wherein the area having the tactile pattern is provided on the hollow body and the top portion.

* * * * *